United States Patent [19]

Yamazaki et al.

[11] Patent Number: 4,794,064

[45] Date of Patent: Dec. 27, 1988

[54] AMORPHOUS SILICON ELECTROPHOTOGRAPHIC RECEPTOR HAVING CONTROLLED CARBON AND BORON CONTENTS

[75] Inventors: Toshinori Yamazaki; Tatsuo Nakanishi; Hiroyuki Nomori, all of Hachioji, Japan

[73] Assignee: Konishiroku Photo Industry Co., Led., Tokyo, Japan

[21] Appl. No.: 11,375

[22] Filed: Feb. 5, 1987

Related U.S. Application Data

[63] Continuation of Ser. No. 799,029, Nov. 18, 1985, abandoned, which is a continuation-in-part of Ser. No. 611,157, May 17, 1984, abandoned.

[30] Foreign Application Priority Data

May 18, 1983 [JP] Japan ..... 58-86893
May 18, 1983 [JP] Japan ..... 58-86894

[51] Int. Cl.[4] ..... G03G 5/085

[52] U.S. Cl. ..... 430/58; 430/64; 430/66; 430/84

[58] Field of Search ..... 430/57, 84, 85, 86, 430/94, 58, 64, 66

[56] References Cited

U.S. PATENT DOCUMENTS 4,341,851 7/1982 Mooney et al. ..... 430/94
4,460,669 7/1984 Ogawa et al. ..... 430/84
4,464,451 8/1984 Shirai et al. ..... 430/84

*Primary Examiner*—John L. Goodrow
*Attorney, Agent, or Firm*—Frishauf, Holtz, Goodman & Woodward

[57] ABSTRACT

An electrophotographic photoreceptor comprising a photosensitive layer comprising at least one compound selected from the group consisting of hydrogenated amorphous silicon, fluorinated amorphous silicon, a surface modifying layer formed on the upper surface of said photosensitive layer comprising at least one compound selected from the group consisting of hydrogenated amorphous silicon carbide, fluorinated amorphous silicon carbide, hydrogenated and fluorinated amorphous silicon carbide, hydrogenated amorphous silicon nitride, fluorinated amorphous silicon nitride, and hydrogenated and fluorinated silicon nitride, a charge transport layer formed on the lower surface of said photosensitive layer comprising at least one compound selected from the group consisting of hydrogenated amorphous silicon carbide, fluorinated amorphous silicon carbide, and hydrogenated and fluorinated amorphous silicon carbide, the carbon content of said charge transport layer is within the range of 5 to 30 atomic % and said charge transport layer is doped with at least one element from group III of the periodic table, a charge blocking layer formed on the lower surface of said charge transport layer comprising at least one compound selected from the group consisting of hydrogenated amorphous silicon carbide, fluorinated amorphous silicon carbide, and hydrogenated and fluorinated amorphous silicon carbide, doped with larger amount of at least one element from group III of the periodic table than the amount of group III element dope in said charge transport layer, and a substrate.

16 Claims, 11 Drawing Sheets

AMORPHOUS SILICON ELECTROPHOTOGRAPHIC RECEPTOR HAVING CONTROLLED CARBON AND BORON CONTENTS

This application is a continuation of application Ser. No. 799,029, filed Nov. 18, 1985, now abandoned, which is a continuation-in-part of Ser. No. 611,157, filed May 17, 1984 (now abandoned).

BACKGROUND OF THE INVENTION

1. Field of the Invention

The present invention relates to an electrophotographic photoreceptor, more particularly a positively-charged type photoreceptor for use in electrophotography.

2. Description of the Prior Art

For use as electrophotographic photoreceptors, selenium photoreceptor, or selenium photoreceptor doped with As, Te, Sb or the like, and photoreceptors with zinc oxide or cadmium sulfide dispersed in binder resin are known. These photoreceptors, however, encounter problems in respect of environmental pollution, thermal instability and insufficient mechanical strength.

In recent years, an amorphous silicon (hereinafter referred to as a-Si) based electrophotographic photoreceptor has been proposed. The a-Si has so-called dangling bonds where the Si-Si bond is broken. This type of defect generates many localized energy levels in the energy gap. Because of this, hopping conduction of thermally excited carriers occurs to lower the dark resistance while photoexcited carriers are trapped by the localized energy levels, resulting in poor photoconductivity. It is known to neutralize these defects with hydrogen atoms, namely, to saturate the dangling bonds of silicon atoms with hydrogen atoms.

The hydrogenated amorphous silicon (hereinafter referred to as a-Si:H) exhibits a resistivity of $10^8$ to $10^9\Omega$-cm in the dark, which is only about ten thousandth as low as that of amorphous selenium. The photoreceptor comprising a single layer of a-Si:H, therefore, has problems in that its surface potential decays in the dark at a high rate and its initial charge potential is low. a-Si:H, however, has a very favorable characteristic for the photosensitive layer of the photoreceptor in that its resistivity decreases greatly when it is exposed to light in the visible and infrared spectral portions.

To endow such a-Si:H with potential retention, it can be doped with boron to increase its resistivity to a level as high as $10^{12}\Omega$-cm. However, it is not easy to properly control the boron doping level and others with accuracy. Further, resistivity as high as $10^{13}\Omega$-cm can be attained by introducing a trace of oxygen with boron. In this case, the photoreceptor exhibits inferior photosensitivity, causing problems such as potential drop in the light and nonnegligible residual potential.

The photoreceptor with a-Si:H exposed in the surface has not yet been fully studied in relation to the chemical stability of its surface, such as, possible influences, as from long-term exposure to atmosphere, or of moisture and chemicals generated under corona discharge. For example, it is known that after having been left to stand for more than a month, it is affected greatly by moisture with a large decrease in the charge potential.

On the other hand, a hydrogenerated amorphous silicon carbide (hereinafter referred to as a-SiC:H) and a method for the production thereof are described in Phil. Mag., Vol. 35 (1978), etc. The material is known to have characteristics such as greater heat resistance, higher surface hardness, and better good dark resistivity ($10^{12}$ to $10^{13}\Omega$-cm) than that of a —Si:H, and an optical energy gap varying between 1.6 and 2.8 eV depending on the carbon content. It however has the disadvantage of inferior sensitivity in the long wavelength region resulting from the windening of the band gap caused by carbon contained therein.

An electrophotographic photoreceptor, as referred to hereinbefore, comprising in combination a-SiC:H and a-Si:H was disclosed, for example, in Japanese laid-open Patent Application No. 127083/1980. It is of two-layer structure, each layer performing a different function, consisting of a photosensitive or photoconductive layer of a-Si:H and a charge transport layer of a-SiC:H under the former. Thus the upper layer plays the role of achieving photosensitivity to light in a wide wavelength region and the lower layer, which is combined heterogenously with the a-Si:H layer, although adapted to improve the charge potential cannot successfully prevent dark decay inherent in a-Si:H layer, with consequent poor charge potential inadequate for practical use. The chemical stability, mechanical strength, heatproofness, etc. are inferior as attributable to the upper layer of a-Si:H. Besides the charge transport layer remained to be studied relative to the carbon atom content and consideration is given to the thickness of the layers. Accordingly, the electrophotographic receptor does not meet requirements for the desired characteristics. Japanese laid-open Patent Application No. 17952/1982 discloses a three-layer structure photoreceptor, each layer performing a different function, consisting of a photosensitive layer of a-Si:H, a surface modifying layer or the first a-SiC:H layer over the photosensitive layer and a charge transport layer or a second a-SiC:H layer on the opposite side or on the side toward the substrate electrode of the photosensitive layer. It has an advantage of preventing the dark decay inherent in a-Si:H layer. Effects of carbon atom content in the a-SiC:H layer, particularly the charge transport layer, remained to be studied. Thus in either combination with a-Si:H layer, reduced sensitivity and raised residual potential appears. It has too poor stability to produce a large number of copies.

OBJECTS AND SUMMARY OF THE INVENTION

It is the principal object of the invention to provide a new photoreceptor composed of three layer performing different functions, features of which reside in having the carbon content in the charge transport layer, and impurity levels in the charge transport layer and a charge blocking layer set within appropriate ranges, with special attention paid to the fact that characteristics of the photoreceptor are greatly dependent on the content and levels, and thus superior results are obtained particularly in photosensitivity, residual potential, potential retention and many times-stability in positively-charged use.

The photoreceptor embodying the present invention comprises a surface modifying layer made of hydrogenated and/or fluorinated amorphous silicon carbide and/or nitride such as a-SiC:H, a-SiN:H, a photoconductive layer made of amorphous hydrogenated and/or fluorinated amorphous silicon such as a-Si:H, a charge transport layer made of amorphous hydrogenated and/or fluorinated silicon carbide such as a-SiC:H doped with a relatively small amount of at least one element from group IIIA of the periodic table, and a charge blocking layer made of amorphous hydrogenated and/or fluorinated silicon carbide such as a-SiC:H doped with a relatively large amount of at least one element from group IIIA of the periodic table, wherein the carbon atom content in the charge transport layer is within the range of 5 to 30 atomic %, and preferably at least 10%.

BRIEF DESCRIPTION OF THE DRAWINGS

Other features and advantages of the invention will be apparent from the following description taken in connection with the accompanying drawings wherein:

FIG. 1 is a partial cross-sectional view of an electrophotoreceptor representing the prior art;

FIG. 2 shows a curve of optical energy gap vs. carbon content for a-SiC:H;

FIG. 3 shows curves of specific resistance against optical energy gap for a-SiC:H;

FIG. 4 is a characteristic curve of photosensitivity vs. optical energy gap for a-SiC:H;

FIG. 5 shows in comparison curve of photosensitivity against wavelength of incident light;

FIG. 6 is a diagram showing energy bands of the layers of the photoreceptor;

FIG. 7 is a graph showing the potential decay characteristic of a photoreceptor;

FIG. 8 is a curve showing the potential decay characteristic of another photoreceptor;

FIG. 9 is a potential decay curve of the photoreceptor of FIG. 1 when charged positively;

FIG. 10 is a partial cross-sectional view of another photoreceptor;

FIG. 11 is a diagram showing energy bands of the layers of the photoreceptors shown in FIG. 10;

FIG. 12 is a potential decay curve of the photoreceptor of the FIG. 10 when charged positively;

FIGS. 13 through 18 are presented as involved in the invention.

FIG. 13 is a diagram showing energy bands of the layers of the photoreceptor;

FIG. 14 is a potential decay curve of the photoreceptor ween charged positively;

FIG. 15 is a graph showing the change in characteristic against thickness of the surface modifying layers;

FIG. 16 is a sectional view of an apparatus for manufacturing the photoreceptor illustrated schematically.

DESCRIPTION OF THE PREFERRED EMBODIMENTS

Figure 1:
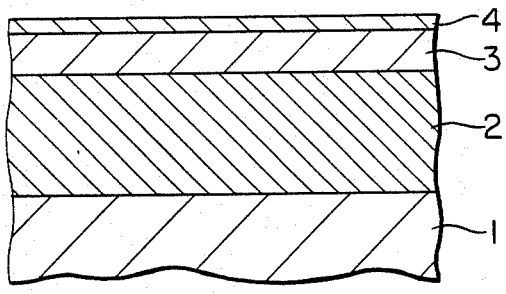
FIGS. 1 to 12 are presented for easier understanding of the invention.

The invention will be described more fully by way of examples hereinafter:

Firstly, the invention has been accomplished as follows:

A receptor shown in FIG. 1 comprises an electroconductive substrate 1, a charge transport layer 2, a photosensitive layer 3, and a surface modifying layer of 4.

The charge transport layer (a-Si:H layer) 2 has mainly potential retention and charge transport functions and an effect to improve adhesiveness to the substrate 1. It has a carbon atom content of 5–30 atomic % essentially set in relation to the total amount of Si and C, with a preferable thickness 10–30 μm. The photosensitive layer 3 (a-Si:H layer) is capable of generating charge carriers in proportion to irradiation and preferably is from 2500 Å to 10 μm thick. The surface modifying layer (a-Si:H or a-SiN:H layer) 4 functions to improve the surface potential characteristic of this photoreceptor, to maintain its potential characteristics and to prevent environmental affection by moisture, atmosphere and chemicals produced under corona discharge throughout a long term, and to improve printing resistance because of the high surface hardness, hot transfer performance, particularly adhesive transferability, etc., thus performing the so-called surface modifying function. It is important that the thickness of this layer is from 400 Å to 5000 Å, preferably 400 Å$\leqq$t$<$2000 Å which is far smaller than the prior art.

The a-Si-based photoreceptor for use in electrophotography having the features of the present invention, can have a small film thickness with retention of higher potential, good sensitivity to light in the visible infrared regions superior heat-proofness, printing resistance and environmental stability, compared with the prior art selenium photoreceptor.

Figure 2:
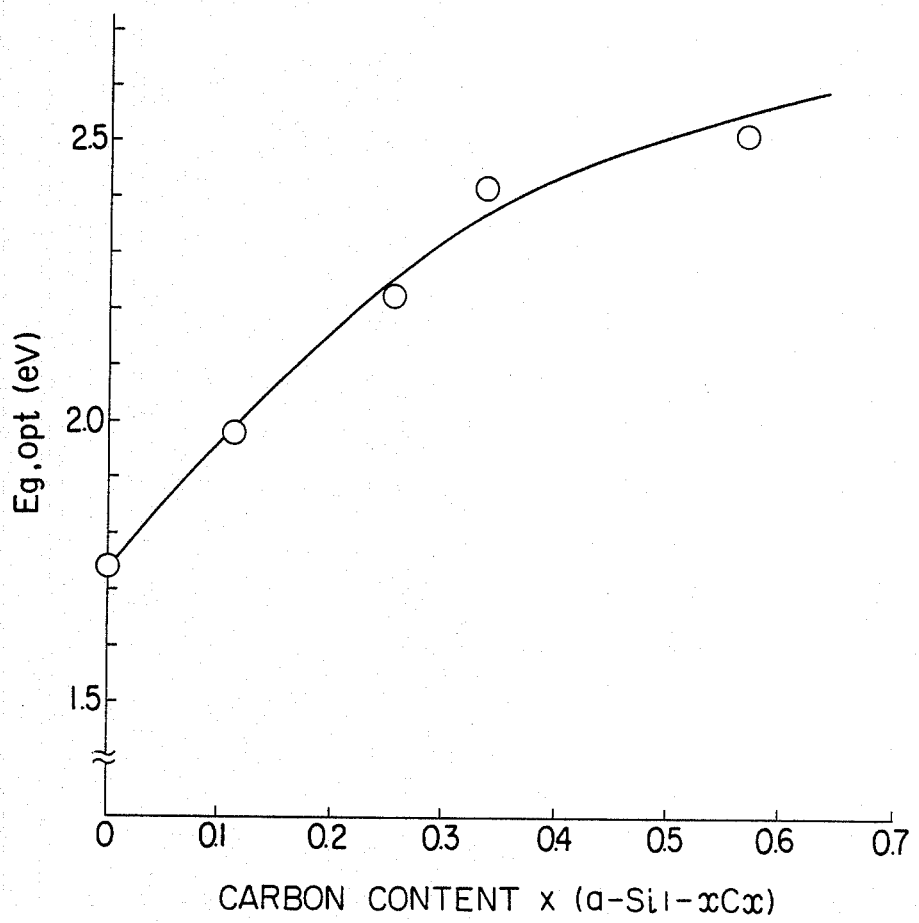

Attention should be drawn to the fact that setting of the carbon atomic content in the charge transport layer within a specified range between 5 and 30 atomic % enables it to meet the requirements for characteristics of the photoreceptor. This will be described in detail:

A-SiC:H is generally proven to have an optical energy gap (Eg, opt) which increases with higher carbon content as shown in FIG. 2. It oorresponds to band gap, and, as known, the higher the carbon atom content is, the difference from the Eg, opt of a-Si:H (about 1.71 eV) becomes larger.

Figure 3:
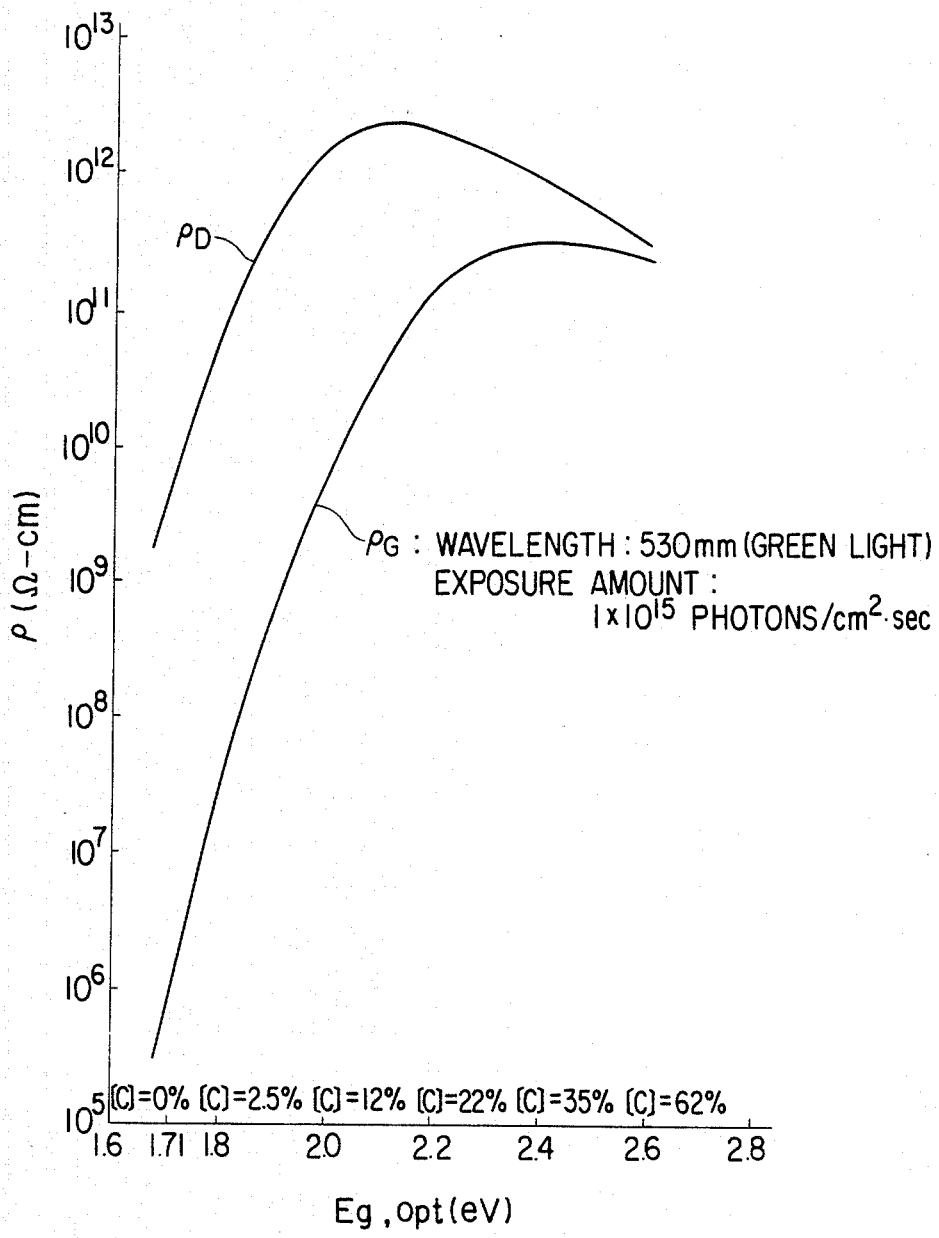
Figure 4:
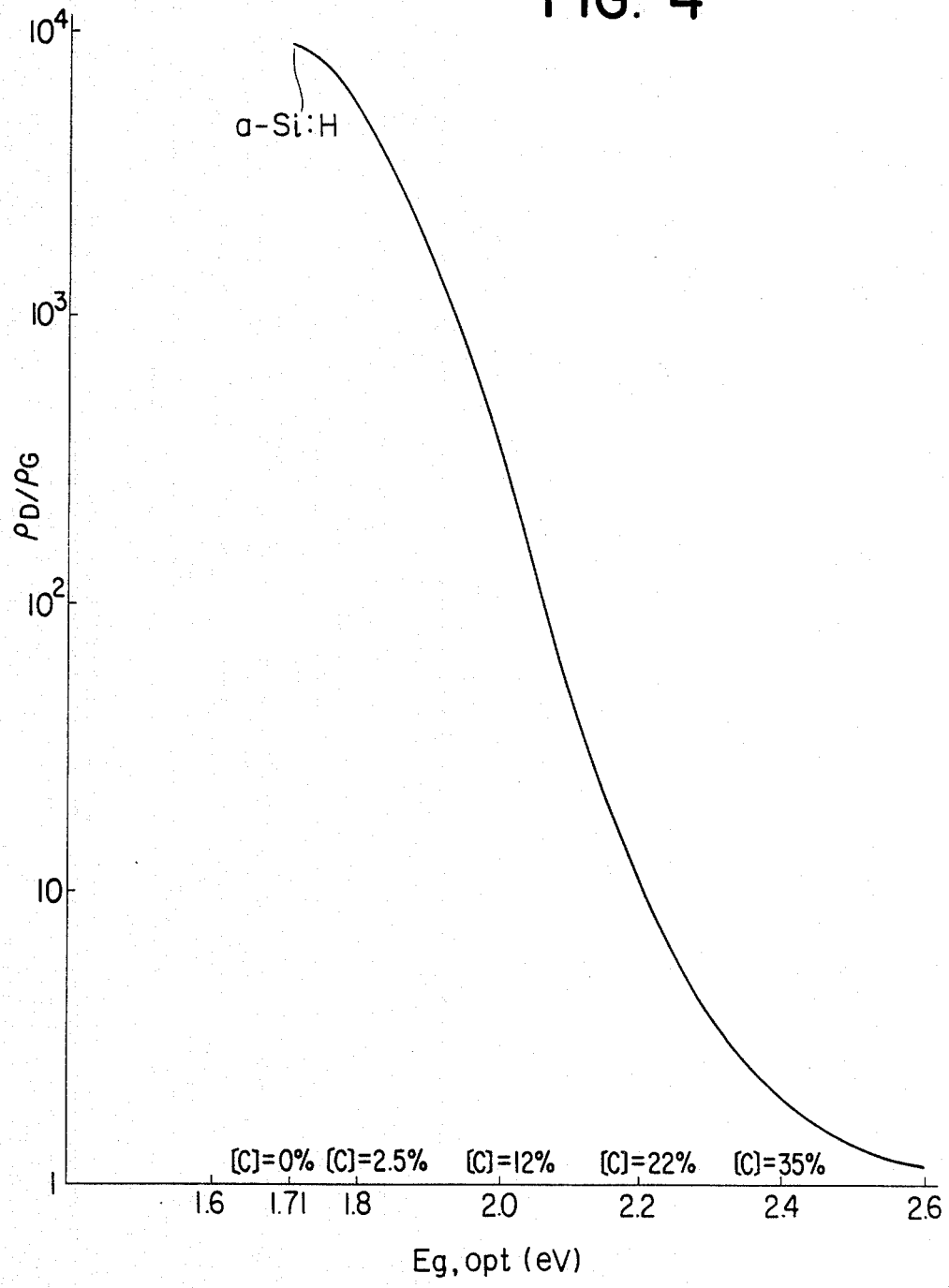
Figure 5:
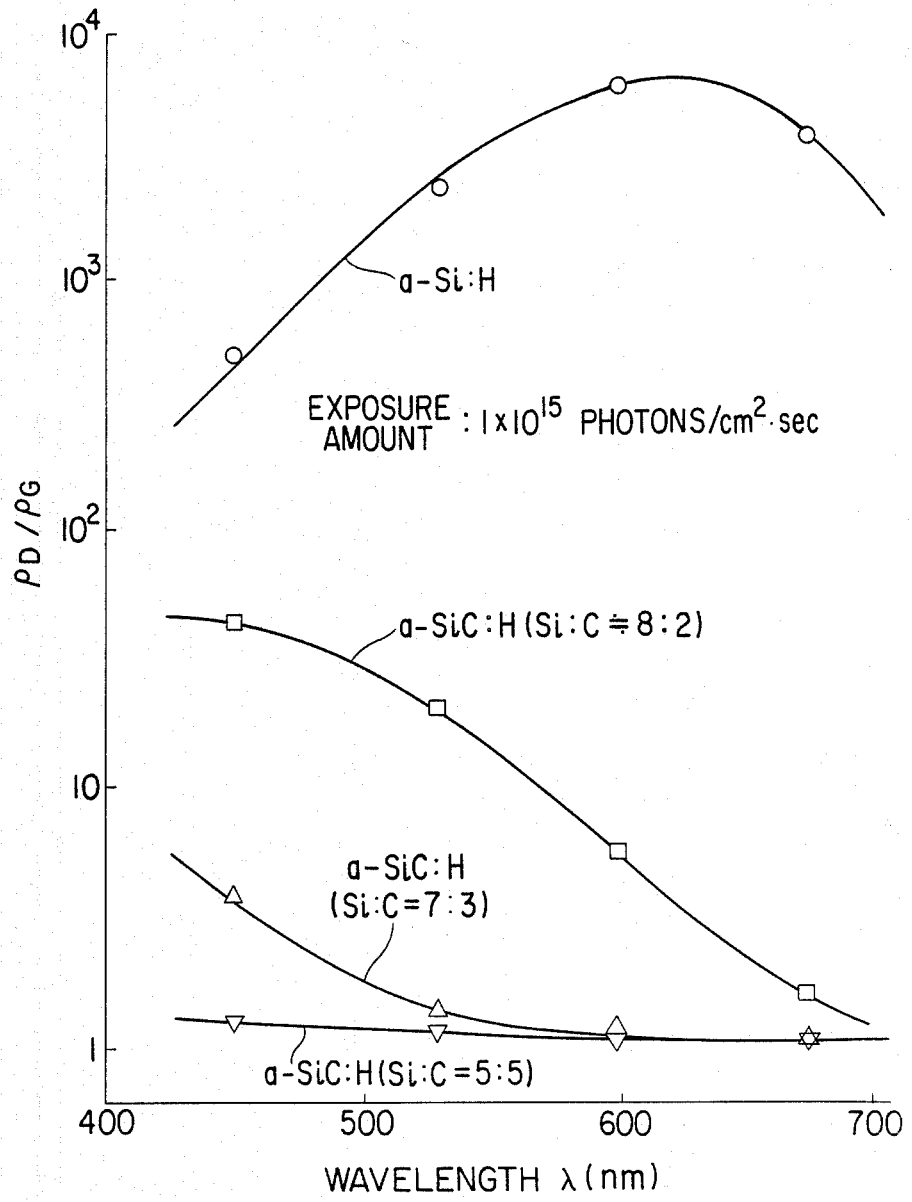

On the other hand, carbon atom content exerts influence on the specific resistance of a-SiC:H ($\rho_D$; dark resistivity, $\rho_G$; resistivity when exposed to green light), as shown in FIG. 3. An increase in the carbon content of Eg, opt beyond a certain range causes a drop in photosensitivity ($\rho_D/\rho_G$) the region, as shown in FIG. 4. Variation in wavelength of incident light causes a change in photosensitivity of a-SiC:H depending on the carbon content, as shown in FIG. 5.

Figure 6:
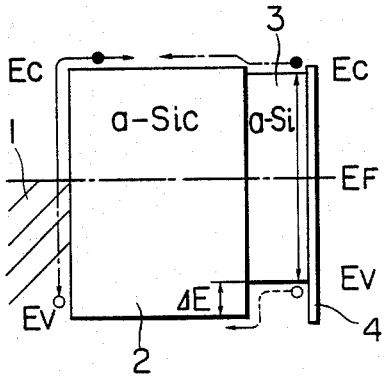

FIG. 6 illustrates the energy bands of the photoreceptor of layered construction described in FIG. 1. In the energy band diagram, the charge transport layer 2 has a content of from 5 to 30 atomic %, (such as 15 atomic %: Eg, opt=2.1 eV in the illustrated photoreceptor), consequently with an appropriate Eg, opt the interface of which Eg, opt (approx. 1.71 eV for the photosensitive layer 3 constitutes a band gap which substantially does not form a barrier particularly against electrons. When the surface of the photoreceptor is negatively charged and the operation starts, a hole designated at mark will be injected from the substrate 1 as the dash-and-dot line indicates. The hole cannot get over the energy barrier of valence band Ev of the charge transport layer. This permits thorough retention of negative charges on the surface of the photoreceptor, decrease in dark decay and improvement in potential retention. Out of carriers (holes designated by ; mark or electrons by generated in the photosensitive layer 3 when irradiated, electrons are readily migratable into the substrate 1, as indicated by a dash-and-dot-line, through the charge transport layer 2 because of substantially no barrier of the conduction band (Ec) between layers 2 and 3. There is a matching of energy level between both. On the other hand, holes readily move toward the surface through the thin surface modifying layer 4 which causes selective neutralization of negative charges on the surface, with consequent efficient production of an electrostatic latent image. This receptor, therefore, has good photosensitivity as well as the abovementioned potential retention.

It has proven that such a marked effect occurs under the specified condition when the carbon atom content in the charge transport layer 2 is within 5–30 atomic %. Less than 5 atomic % of carbon content is inadequate because it is associated with a specific resistance of charge in the transport layer 2 less than $10^{12}\Omega$-cm which is necessary to establish potential retention (See FIG. 3), and thus a sufficiently high charge potential cannot be attained. At carbon atom contents exceeding 30 atomic %, likewise specific resistance is low, and too many carbon atoms are present, resulting in an increase in defects in the charge transport layer which contributes to inferior transportability of the carriers.

Figure 7:
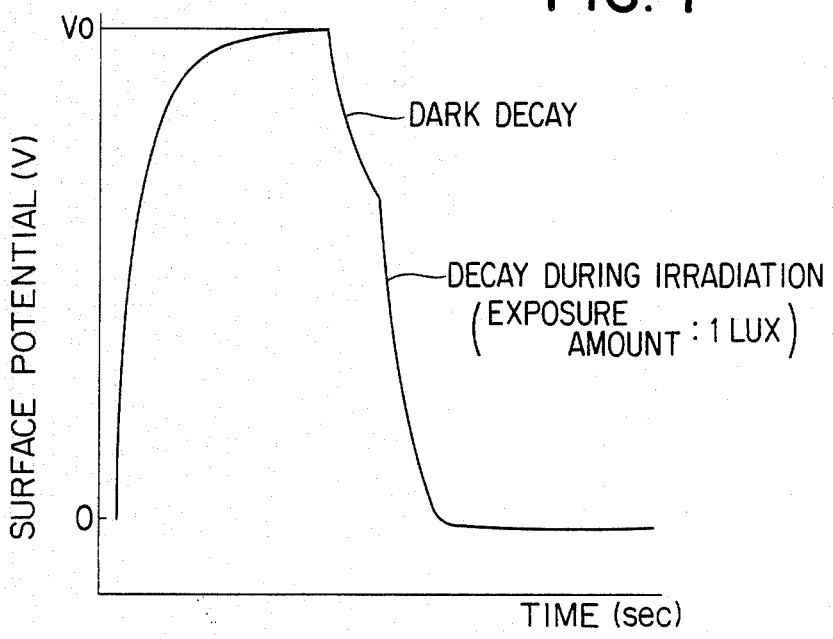
Figure 8:
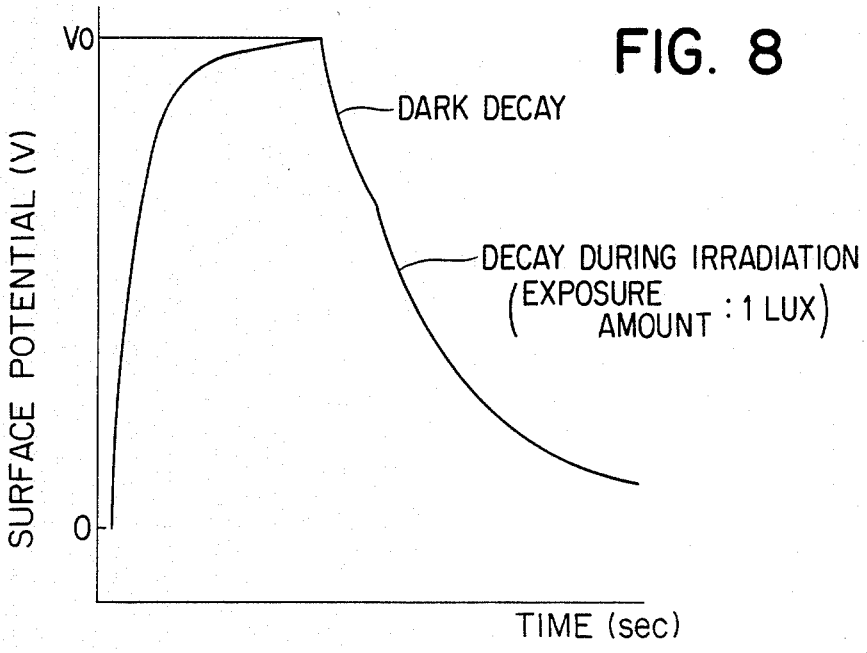

Additionally, it is important that the photoreceptor illustrated in FIG. 1 comprises a photosensitive layer 3 free of any dopant from group IIIA of the periodic table. Attempts to estabiish higher resistivity ($\rho_D = 10^{11}$–$10^{12}\Omega$-cm) by doping with an impurity in the same way as in the prior art, will cause a decrease in the carrier range ($\mu\tau$)e of electron: mobility×life time. Then a gradually downward sloping curve of decay in the light is obtained, with consequent reduction in sensitivity and deterioration of picture quality. FIG. 7 shows the decay characteristic in the light of the abovementioned photoreceptor with a photosensitive layer 3 free of dopant. The curve exhibits a sharp fall in potential when irradiated, which is associated with good photosensitivity. On the other hand, it has been proven with a photosensitive layer 3 doped with an impurity, (for example, assuming $[B_2H_6]/[SiH_4] = 20$ ppm. in the later-described glow discharge), the decay curve in the light descends by a gradual slope as shown in FIG. 8. The photoreceptor illustrated in FIG. 1 comprising, as structural components, three layers performing different functions has the remarkable advantages above-mentioned.

Figure 9:
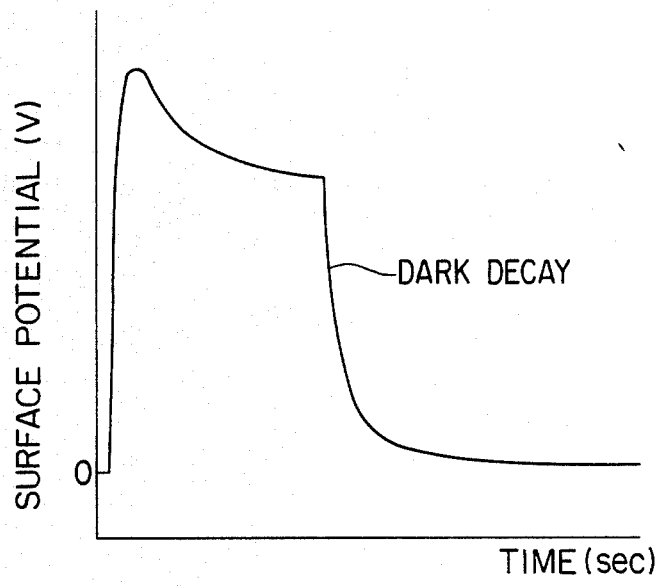

The photoreceptor shown in FIG. 1 is appropriate to be negatively charged, as understood from FIG. 6 which diagrams the energy bands and the above given description. For positively-charged use, it has a small chargeability and undergoes a large dark decay. Thus, as is apparent from FIG. 6, for example, if a photoreceptor with a charge transport layer 2 having a carbon atom content of 15 atomic $\pi$and an Eg, opt of 2.06 eV is charged positively on the surface, electrons readily get over Ec of the charge transport layer 2 and are injected from the substrate 1, with consequent neutralization of positive charges on the surface, involving a tendency to decay the surface potential. Additionally, when carriers are generated in the photosensitive layer 3 by irradiation, holes have difficulty in migration from the photosensitive layer 3 to the charge transport layer 2 because of the energy gap Ev between both layers 3 and 2 or the energy barrier ($\Delta E$). In this manner, the Eg, opt of a-Si:H is 1.71 ev, and the Eg, opt of a-SiC:H is 2.06 eV. These reflect inferior positive chargeability. The decay curve shown in FIG. 9 is obtained, thus leading to the conclusion that it is inappropriate for positively-charged use.

Figure 10:
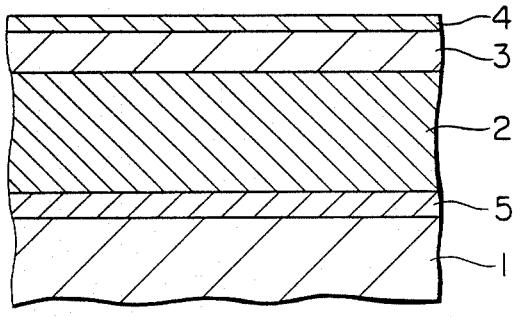
Figure 11:
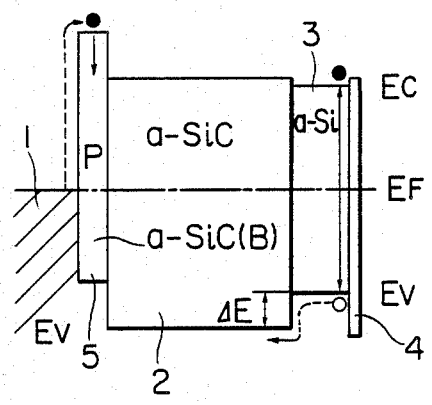
Figure 12:
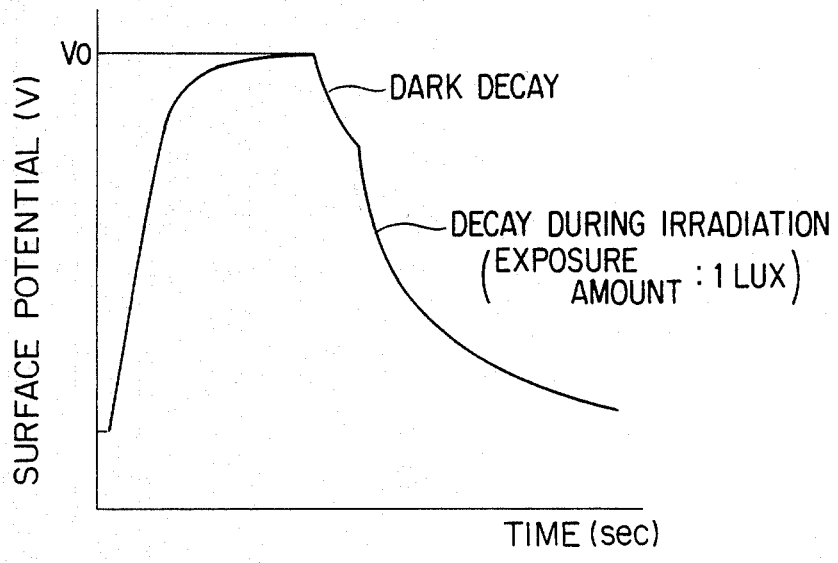

It was conceived that, as illustrated in FIG. 10, in order to prevent electrons from migrating from the substrate 1, compared with the photoreceptor shown in FIG. 1, a charge blocking layer 5 of boron-doped, p-type a-SiC:H or a-SiC:F was additionally provided between the charge transport layer 2 and the substrate 1. As the result, as diagrammed in FIG. 11, the possibility to block the injection of electrons from the substrate 1 and retain positive charges on the surface of the photoreceptor, or to reduce dark decay, is produced, still accompanied by inferior photosensitivity attributable to the energy barrier ($\Delta E$), as above-mentioned. Then a surface potential curve with a gradually downward sloping portion is obtained when irradiated.

The inventors' earnest approach to the above-mentioned problem arisen under positively-charged condition was made. And the inventors recognized that it was inadequate only to block injection of carriers by means of the charge blocking layer 5 and that it was further necessary to take effectual countermeasure to cause holes, which were generated in the photosensitive layer when the light was irradiated, to efficiently move the charge transport layer 2.

One of the means for achieving this is to reduce $\Delta E$ between layers 3 and 2 by decreasing the carbon content of a-SiC:H constituting the charge transport layer 2 on the basis of data plotted in FIG. 2. This requires a large reduction in the carbon atom content to less than 5 atomic %, resulting in a large drop in the charging potential of the photoreceptor.

The inventors found that for the problem to be soluble by the way that, in order to take the level matching of Ev between layers 3 and 2, a relatively small amount of at least one from group IIIA of the periodic table is doped into a-SiC:H layer 2, with the carbon atom content in a-SiC:H layer as maintained to keep well the charging characteristic and transport capability. In this way, the invention has been accomplished.

As above-described, the photoreceptor according to the invention is principally of the layered structure as illustrated in FIG. 10, is characterizdd in that a-SiC:H layer 2 is doped with a relatively small amount of at least one element from group IIIA of the periodic table, such as boron, and that charge transport layer 2 has a carbon atomic content set within 5–30 atomic % and that a-SiC:H layer 5 for charge blocking layer is doped with a relatively large amount of at least one element from group IIIA of the periodic table such as boron.

Figure 13:
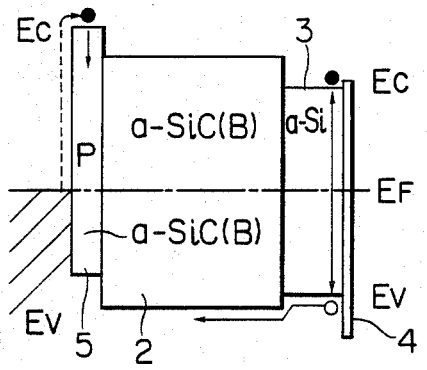

As the result of the boron doping, layer 2, as diagrammed in FIG. 13, has an Ev with such a decreased gap from that of the photosensitive layer 3, that the matching of energy level between the both layers is well attainable. Consequently, holes generated in the photosensitive layer 3 when irradiated can be injected smoothly into the charge transport layer 2. Then injection of electrons from the substrate 1 can be effectually blocked by the charge blocking layer 5 provided.

Figure 14:
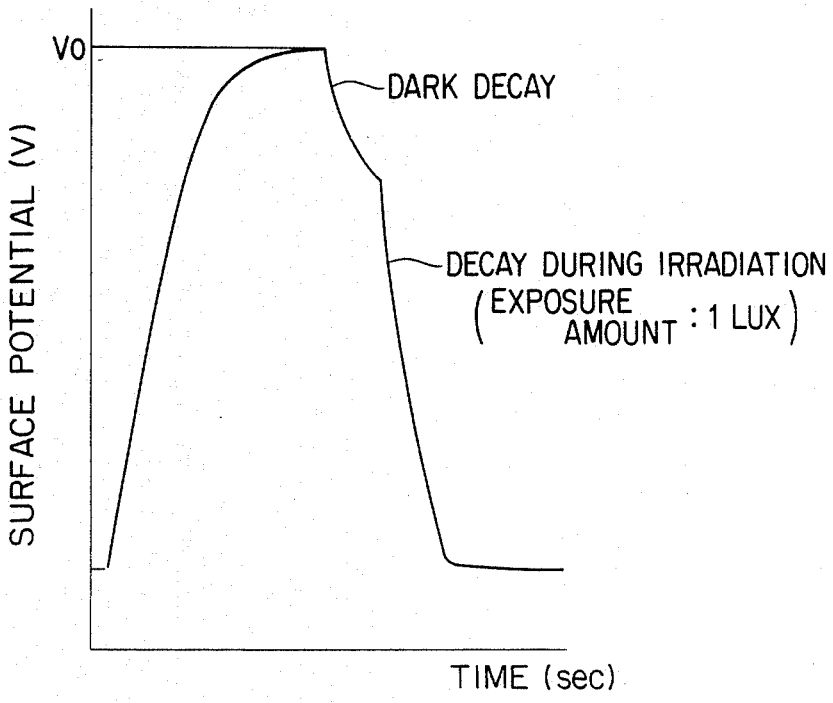

In this way, a photoreceptor exhibiting satisfactory decay characteristic for positively-charged type, as shown in FIG. 14, has been obtainable. The photoreceptor has an improved photosensitivity, reduced residual potential, exhibits a sharp light decay characteristic and is capable of maintaining higher charge potential.

Further, the charge transport layer 2 should have a carbon atom content set within the range 5–30 atomic % such as of 15 atomic %, for, in addition to the above-described reasons: retention of charge potential and improvement in charge transport capability, particular reason for positively-charged type: high carbon contents exceeding 30 atomic % would cause too great an energy gap, which requires more boron to be doped to permit matching of energy level of Ev. Such increase in amount of boron doped, however, inevitably leads to low resistivity and consequently inferior charge characteristic.

It is amounts of boron to be doped into a-SiC:H layers 2 and 5 that is important for obtaining the photoreceptor according to the invention shown in FIG. 13. It is noteworthy that the charge transport layer is formed by glow discharge decomposition under the condition of flow rate ratio: $[B_2H_6]/[SiH_4]=1-100$, such as 10 ppm., and the charge blocking layer is preferably formed into P-type by glow-discharge decomposition under the condition of flow rate ratio $[B_2H_6]/[SiH_4]=200-2000$ ppm., such as 1000 ppm.

Individual layers of the photoreceptor according to the invention are more fully described below:

Surface modifying layer

This surface modifying layer 4 is essential to improve the surface of photoreceptor in quality and thereby provide an a-Si photoreceptor excellent for practical use. It performs two basic functions of the electrophotographic photoreceptor: charge retention on the surface and the photo-induced decay of surface potential imparted to the photoreceptor. The provision of the surface modifying layer makes the characteristic performance of the photoreceptor so stabilized in repeated charging and photo-induced decay that, after the photoreceptor is left to stand for a long period, for example, longer than a month, favorable characteristics can still be reproduced. By contrast, the photoreceptor with a surface of a-Si:H or a-Si:F is liable to moisture, the air, and atmosphere containing ozone, so its potential characteristics change much with time. Further, its surface hardness is high and the surface modifying layer is wear resistant in its copy process steps of development, image transfer, cleaning, etc. In addition, its head resistance is high and it may be used for heating process, for example, of adhesion transfer.

Figure 15:
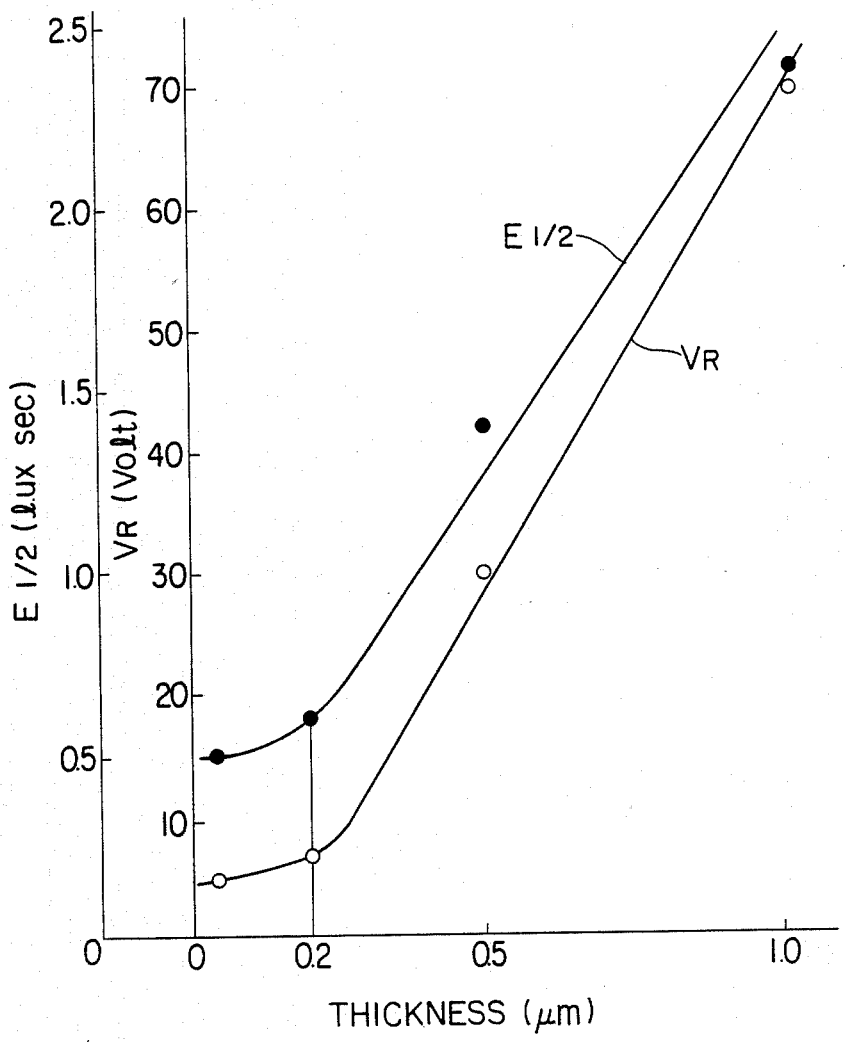

For overall achievement of the superior effects as mentioned above, the surface modifying layer is preferably made of a-SiC:H, a-SiC:F, a-SiN:H or a-SiN:F and it is very important to have a thickness selected in the aforementioned range of 400 Å$\leqq t \leqq$5000 Å, preferably 400 Å$\leqq t \leqq$2000 Å because thicknesses of 5000 Å or more are associated with a high residual potential level, as presented in FIG. 15, and decline in the sensitivity E1/2 (later described), resulting in loss of favorable characteristics of the a-Si-based photoreceptor. On the other hand, in the case of thickness below 400 Å no charging occurs on the surface through the tunnel effect, resulting in increased dark decay and remarkable decline in the photosensitivity. This is why it is essential for the surface modifying layer 4 to have a thickness selected in a range from 400 Å to 5000 Å, preferably less than 2000 Å. The thickness range can never be anticipated from the prior art.

Further, it has been found important for the surface modifying layer 4 to have a properly-selected content in it for taking the above favorable effects of it. If we express the chemical composition of this layer by a-$Si_{1-x}C_x$:H, a-$Si_{1-x}C_x$:F, a-$Si_{1-x}N_x$:H or a-$Si_{1-x}N_x$:F, the preferable range of parameter x is from 0.1 to 0.7 (carbon or nitrogen content from 10 to 70 atomic percent). Assuming $0.1 \leqq x$, the optical energy gap amounts to about 2.0 eV or greater. Besides, it has an optical transparency or takes the so-called "window effect" for light in the visible and infrared regions and incident light will reach the photosensitive layer 3 (charge generation layer). If $x<0.1$, a part of incident light is absorbed to the surface modifying layer 4, reflecting the tendency towards decline in the photosensitivity of the photoreceptor. Assuming that parameter x exceeds 0.7, the layer is substantially composed of carbon alone, with not only loss of semiconductive characteristic but also decreased speed of film-deposition of a-SiC:H, a-SiN:H, a-SiC:F or a-SiN:F by the flow discharge technique. This is why $x \leqq 0.7$ is preferable.

Charge transport layer

The charge transport layer is made of a-SiC:H and/or a-SiC:F, and performs two functions: potential retention charge transport. It has a dark resistivity of not less than $10^{12}$ Ω-cm, a resistance to high electric field, and a high potential retention per unit thickness of layer. It also takes effects of making barrier against holes to be injected frmm the photosensitive layer 3 smaller by the aforesaid doping with impurity (light doping), and thereby permitting efficient transport of holes with great mobility and long life into the substrate 1. The energy gap is set according to the desired carbon content between 5 and 30 atomic % so that holes are generated efficiently in proportion to radiation and no barrier against them is established. Thus the change transport layer 2 contributes to retention of high surface potential of practical level, and to efficient and rapid transport of charge carriers generated in the photosensitive layer 3, and consequently the provision of a photoreceptor with a higher sensitivity and free from residual potential.

To perform this function, for example, in xerography according to Carlson's technique, the charge transport layer 2 should have a thickness between 10 μm and 30 μm, because a thickness below 10 μm is too thin to achieve the surface potential necessary for development whereas at a thickness above 30 μm, the rate of carriers which can reach the substrate 1 will decrease. The thickness of the a-SiC:H layer thinner than that of the selenium photoreceptor, for example, a few over 10 μm permits surface potentials of practical use level.

Photosensitive layer

Photosensitive layer 3 is made of a-Si:H and/or a-Si:F, and exhibits a high photoconductivity responding to visible and infrared spectral portions. As illustrated in FIG. 5 at red spectral wavelengths near 650 nm $\rho_O/\rho_L$ ratio assumes its maximum value of $10^4$. Such a photosensitive layer of a-Si:H or Si:F contributes to higher sensitivity of photoreceptor to the visible an infrared spectral portions.

To thoroughly and efficiently absorb visible and infrared spectra for generation of charge carriers, the photosensitive layer 3 should be 2500 Å to 10 μm thick.

The photosensitive layer of below 2500 Å in thickness can partially absorb incident light, and a part of incident light reaching the underlying charge transport layer 2 causes a substantial decline in the photosensitivity. The photosensitive layer 3, which is endowed with a high charge transport capacity, has a resistivity of less than $10^9$ Ω-cm consequently with no charge retention by itself, and so does not need greater thickness than necessary to absorb light for a photosensitive layer. Thus, it may be satisfactory to have a thickness not more than 10 μm.

Charge blocking layer

The blocking layer 5 for blocking injection of electrons from substrate 1 is doped with a relatively large amount of at least one element from group IIIA of the periodic table (heavy doping) to establish an energy gap from the substrate 1 necessary for performing the blocking function. It is made of a-SiC:H or a-SiC:F layer, with consequent good properties of adhesiveness to substrate 1 and film coating.

The blocking layer 5 should have a thickness between 400 Å–2 μm to perform the function. Thicknesses of less than 400 Å are too thin because of inadequate blocking function At thickness exceeding 2 μm, carriers tend to diffuse crosswise owing to low resistance of the layer. Carbon content of blocking layer 5 should be within the range of 5–30 atomic %.

Figure 16:
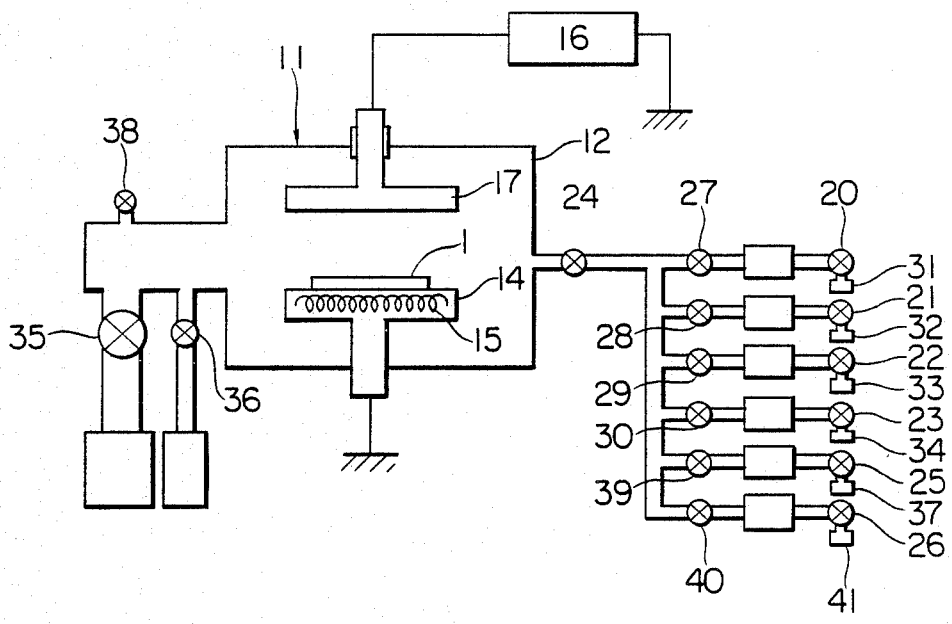

An apparatus or glow discharger for use in manufacuuring the photoreceptor embodying the present invention together with a method of preparing it will be described below with reference to FIG. 16 in the following:

The apparatus 11 has a vacuum chamber 12, in which such a substrate 1 as mentioned above is held on a substrate holder 14 with a built-in heater 15 for heating the substrate 1 to a prescribed temperature. Facing the substrate 1, there is disposed a high frequency electrode 17 to generate glow discharges between itself and substrate 1. In the figure, reference characters 20 through 30, 35, 36, 38, 39 and 40 designate values, 31 a source of $SiH_4$ or other gaseous silicon compound, 32 a source of $CH_4$ or other gaseous carbon compounds, 33 a source of carrier gas, such as Ar or $H_2$, 34 a source of $B_2H_6$, 37 a source of $SiF_4$ gas or fluorine and 41 a source of $N_2$ or gaseous nitrogen compounds. In this glow discharger, first, the substrate 1, for example, an aluminum plate is, after its surface is cleaned, set in the vacuum chamber 12. Then the value 36 is adjusted properly to evacuate the vacuum chamber 12 to a gas pressure of $10^{-6}$ Torr, and the substrate 1 is heated and maintained at a prescribed incubation temperature, such as 200° C. Then, a gaseous mixture containing properly-diluted concentrations of $SiH_4$ or other gaseous silicon compounds and $CH_4$ or other gaseous carbon compounds or $N_2$ or other gaseous nitrogen compounds together with a carrier gas which is an inert gas of high purity, and, if desired, also with $B_2H_6$, are introduced in the vacuum chamber 12, followed by application of a high frequency voltage from the high frequency power supply 16 under a reaction pressure of 0.01 to 10 Torr. The above-mentioned reactant gases are thereby decomposed under glow discharges, resulting in deposition of a-SiC:H layers 5 and 2 containing hydrogen and doped with boron, and a-SiC:H or a-SiN:H layer 4 containing hydrogen on the substrate 1. In this process, the ratio of the flow rate of silicon compound to that of carbon or nitrogen compound and the temperature of the substrate are adjssted properly, for permitting deposition of a-$Si_{1-x}C_x$:H or a-$Si_{1-x}N_x$:H (for example, x is about 0.7) having a desirable composition and containing a desirable width of optical energy gap and for enabling the deposition of a-SiC:H or a-SiN:H at a rate of 1000 Å/min or more without much changes in the electrical characteristics of the deposited a-SiC:H or a-SiN:H. Besides deposition of a-Si:H or the photosensitive layer 3 is accomplishable by glow-discharge decomposition of silicon compound without feeding of carbon compound or nitrogen compound.

All the layers formed 5, 2, 4 should contain hydrogen because otherwise an obtained photoreceptor will fail to have satisfactory charge retention characterisitc for practical use. The hydrogen content therefore should be within the range of 10–30 atomic %. Hydrogen contents of less than 10 atomic % cannot sufficiently compensate dangling bonds whereas those exceeding 30 atomic % tend to provide defective photoreceptors.

The photosensitive layer 3 must contain hydrogen because it is indispensable for the compensation for dangling bonds to thereby improve the photoconductivity and charge retention. The content within range of 10 to 30 atomic % is preferred for the same reasons as above-mentioned.

The compensation for dangling bonds is attainable by introducing into a-Si fluorine instead of hydrogen or in combination with hydrogen by the use of a source of $SiF_4$, thus, converting it to a-Si:F, a-Si:H:F, a-SiC:F, a-SiC:H:F, a-SiN:F or a-SiN:H:F. The content of fluorine should be within the range of 0.5 to 10 atomic %.

The photoreceptor can be prepared by, in addition the above manufacturing techniques based on glow discharge decomposition, various method, such as spattering, ion plating, or vaporization of poly-Si in the presence of hydrogen activated or ionized by a hydrogen discharge tube, particularly the present applicants' method as disclosed in Japanese Laid-Open Application No. 78413/1981 (Application No. 152455/1979).

Reactant gases suitable for use are $SiH_4$, $SiF_4$ and other such as $Si_2H_6$, $SiHF_3$, or their gaseous derivatives, and gaseous lower hydrocarbons such as $C_2H_6$ and $C_3H_8$ and $CF_4$ excluding $CH_4$ and $NH_3$ excluding $N_2$.

Description will be given of examples of photoreceptors embodying the invention used in electrophotography in the following:

An electrophotographic photoreceptor of the structure illustrated in FIG. 10 was prepared with aluminum as a substrate by the glow discharge decomposition method above described. Firstly, a clean aluminum substrate with smooth surface was set in position in the vacuum reaction chamber of a glow discharger. After evacuation of the reaction chamber to a vacuum level of order as high as $10^{-6}$ Torr, the substrate was heated to 200° C. and then argon gas of high purity was introduced. A high frequncy voltage of frequency: 13.56 MHz and power density: 0.04 W/cm$^2$ was applied under a back pressure of 0.5 Torr, and thus preliminary discharge was carried out for 15 minutes. Then reactant gases of $SiH_4$, $CH_4$ and $B_2H_6$ were introduced, the resulting gas mixture of $Ar+SiH_4+CH_4+B_2H_6$ was subjected to glow discharge decomposition in a controlled flow rate ratio. In this way, a-SiC:H layer responsible for charge blocking and a-SiC:H layer responsible for potential retention and charge transport were formed to a predetermined thickness at a deposition rate of 1000 Å/min. An a-Si:H photosensitive layer could be formed to a predetermined thickness by discharge decomposition of $SiH_4$ using Ar gas as a carrier gas and without supply of $CH_4$. Then $CH_4$ was introduced, and a mixture gas ($Ar+SiH_4+CH_4$) was subjected to glow discharge decomposition at a controlled flow ratio to a surface modifying layer of a-SiC:H. Thus, an electrophotographic photoreceptor was prepared.

The resultant photosensitive receptor was set at positive polarity and underwent corona discharge of 6 KV, followed by determination for electrophotographic characteristics. Various samples (No. 1 to 15) of iifferent composition, and varying thicknesses were used and the results obtained are summarized in Table 1.

For testing, the thus-prepared electrophotographic photoreceptor was attached to an electrometer Model: SP-428 (Kawaguchi Co.). Then a voltage of +6KV was applied to the discharge elettrode of the discharger for 10 seconds. The charge potential on the surface of the photoreceptor directly after the completion of charging was considered as $V_0$ (V) At starting after 2 seconds of dark decay, the radiation dose required for causing drop of the charge potential V to half at light was termed half decay exposure E1/2 (lux. sec). Some decay curves of the surface potential during irradiation become flat at some finite potential or without dropping of the srrface potential $V_R$ (V) The prepared photoreceptor in the form of a drum was incorporated into an electrophotographic copying machine, Model: U-BiX V (Konishiroku Photo Ind. Co., Ltd.) and copies were made at 20° C. and 60% RH. The thus-obtained 1OOOth and $2\times10^4$ copies were assessed for picture quality, using the following picture grading system.

| Picture intensity range | Symbol | Picture quality |
|---|---|---|
| Not less than 1.0 | ◎ | Very good |
| 0.6–1.0 | O | Good |
| Not more than 0.6 | Δ | Faded |
| Marked low | X | Not distinguishable |

As clearly shown from the data given in Table 1, compared with sample No. 1 with a charge transport layer free of dopant, Sample No. 2 of our invention with a charge transport layer doped with impurity has remarkable characteristics. Sample Nos. 3 through 6 and 12 through 15 established that combined setting of doping level in the blocking layer within the range of $[B_2H_6]/SiH_4]=200$ to 2000 ppm. and doping level in the charge transport layer within the range of 1–100 ppm. reflects not only good sensitivity and high charge potential retention, but also marked improvement in stability for repeated copying. Besides, it is important that each layer has the composition and thickness within the specified rangss mentioned above.

Under the same conditions as aforesaid, surface modifying layer of a-SiN:H having the specified thickness wa formed with $N_2$ instead of $CH_4$. Samples No. 16 through 30 with a surface modifying layer of a-SiN:H and having various compositions and different thicknesses were prepared and assessed. The yielded results, which are summarized in Table 2, were the same as given in Table 1.

As described above, the photoreceptor according to the invention comprises a surface modifying layer of inorganic substance, an a-Si-based photosensitive layer, an a-SiC-based charge transport layer and an a-SiC-based charge blocking layer, and has advantages for a-Si type photoreceptors, for example for use in electrophotography: thin thicknesses of the layers, retention of high potential, superior sensitivity to the visible and infrared spectral portions. High heat-proofness, good printing resistance, and environmental stability.

Additional advantages reside in the charge transport layer doped with impurity for permitting level matching to the photosensitive layer with consequent ready migration of photo-induced carriers and increase in the photosensitivity, and in the charge blocking layer doped with a large amount of impurity for causing intensification of energy barrier against undesired injection of carriers, contributing to improvement in charge potential retention and increase in dark decay preventing effect.

Finally, attention should be paid to the feature of the carbon atom content in the charge transport layer is restricted within a specified range of 5 to 30 atomic % for providing a photoreceptor having high sensitivity, low residual potential, high potential retention and long-term copying stability.

TABLE 1

| | Surface modifying layer | | | | Photoconductive or photosensitive layer | | | | Charge transport layer | | | |
|---|---|---|---|---|---|---|---|---|---|---|---|---|
| Example | Composition | C (%) | H (%)/F (%) | Thickness | Composition | H (%) | F (%) | Thickness | Composition | C (%) | H (%)/F (%) | doping concentration |
| 1 | a-SiC:H | 15 | 15/0 | 1500Å | a-Si:H | 15 | 0 | 1 μm | a-SiC:H | 15 | 15/0 | — |
| 2 | " | " | " | " | " | " | " | " | " | " | " | 20 PPM |
| 3 | a-SiC:H | 15 | 15/0 | 1500Å | a-Si:H | 15 | 0 | 1 μm | a-SiC:H | 15 | 15/0 | 10 PPM |
| 4 | " | " | " | " | " | " | " | " | " | " | " | " |
| 5 | " | " | " | " | " | " | " | " | " | " | " | " |
| 6 | " | " | " | " | " | " | " | " | " | " | " | " |
| 7 | a-SiC:H:F | 15 | 13/4 | 1500Å | a-Si:H:F | 15 | 5 | 1 μm | a-SiC:H:F | 15 | 13/4 | 20 PPM |
| 8 | " | " | " | " | " | " | " | " | " | " | " | " |
| 9 | " | " | " | " | " | " | " | " | " | " | " | " |
| 10 | " | " | " | " | " | " | " | " | " | " | " | " |
| 11 | " | " | " | " | " | " | " | " | " | " | " | " |
| 12 | a-SiC:H | 15 | 15/0 | 1500Å | a-Si:H | 15 | 0 | 1 μm | a-SiC:H | 15 | 15/0 | — |
| 13 | " | " | " | " | " | " | " | " | " | " | " | 50 PPM |
| 14 | " | " | " | " | " | " | " | " | " | " | " | 100 PPM |
| 15 | " | " | " | " | " | " | " | " | " | " | " | 500 PPM |
| 16 | a-SiC:H:F | 40 | 16/5 | 1500Å | a-Si:H:F | 15 | 5 | 1.5 μm | a-SiC:H:F | 2.5 | 15/5 | 10 PPM |
| 17 | " | " | " | " | " | " | " | " | " | 10 | 15/5 | " |
| 18 | " | " | " | " | " | " | " | " | " | 20 | 13/4 | " |
| 19 | " | " | " | " | " | " | " | " | " | 30 | 15/4 | " |
| 20 | " | " | " | " | " | " | " | " | " | 40 | 16/5 | " |

| | Charge transport | Blocking layer | | | | | Charge | Half decay exposure | Residual | Picture quality | |
|---|---|---|---|---|---|---|---|---|---|---|---|
| Example | layer Thickness | Composition | C (%) | H (%)/F (%) | doping concentration | Thickness | potential $V_0$(V) | amount E ½ (lux. sec.) | potential $V_R$(V) | 1000 copy | 200000 copy |
| 1 | 15 μm | a-SiC:H | 15 | 15/0 | 500 PPM | 5000Å | ⊕610 | 2.5 | 35 | Δ | X |
| 2 | " | " | " | " | " | " | ⊕580 | 1.2 | 2 | ◎ | ◎ |
| 3 | 15 μm | a-SiC:H | 15 | 15/0 | 100 PPM | 5000Å | ⊕290 | 0.7 | 2 | Δ | X |
| 4 | " | " | " | " | 1000 PPM | " | ⊕600 | 0.9 | 3 | ◎ | ◎ |
| 5 | " | " | " | " | 2000 PPM | " | ⊕620 | 1.3 | 7 | ◎ | ◎ |
| 6 | " | " | " | " | 5000 PPM | " | ⊕600 | 2.5 | 20 | O | Δ |

TABLE 1-continued

| | | | | | | | | | | | |
|---|---|---|---|---|---|---|---|---|---|---|---|
| 7 | 15 μm | a SiC:H:F | 15 | 13/4 | 1000 PPM | 200Å | ⊕300 | 0.8 | 3 | Δ | Δ |
| 8 | " | " | " | " | " | 500Å | ⊕570 | 0.9 | 5 | ◎ | ○ |
| 9 | " | " | " | " | " | 5000Å | ⊕610 | 1.1 | 5 | ◎ | ◎ |
| 10 | " | " | " | " | " | 8000Å | ⊕630 | 1.3 | 7 | ◎ | ○ |
| 11 | " | " | " | " | " | 2.5 μm | ⊕680 | 2.8 | 40 | Δ | Δ |
| 12 | 15 μm | a-SiC:H | 15 | 15/0 | 500 PPM | 5000Å | ⊕610 | 2.5 | 35 | Δ | X |
| 13 | " | " | " | " | " | " | ⊕620 | 1.0 | 3 | ◎ | ◎ |
| 14 | " | " | " | " | " | " | ⊕520 | 0.9 | 4 | ◎ | ○ |
| 15 | " | " | " | " | " | " | ⊕300 | 0.9 | 3 | Δ | X |
| 16 | 15 μm | a-SiC:H:F | 15 | 13/4 | 1000 PPM | 5000Å | ⊕370 | 0.6 | 2 | Δ | X |
| 17 | " | " | " | " | " | " | ⊕590 | 0.9 | 5 | ◎ | ○ |
| 18 | " | " | " | " | " | " | ⊕650 | 1.0 | 7 | ◎ | ◎ |
| 19 | " | " | " | " | " | " | ⊕700 | 1.4 | 9 | ◎ | ○ |
| 20 | " | " | " | " | " | " | ⊕770 | 3.5 | 47 | X | X |

TABLE 2

| | Surface modifying layer | | | | Photoconductive or photosensitive layer | | | | Charge transport layer | | | |
|---|---|---|---|---|---|---|---|---|---|---|---|---|
| Example | Composition | C (%) | H (%)/F (%) | Thickness | Composition | H (%) | F (%) | Thickness | Composition | C (%) | H (%)/F (%) | doping concentration |
| 1 | a-SiN:H | 15 | 16/0 | 1500Å | a-Si:H | 17 | 0 | 1 μm | a-SiC:H | 15 | 15/0 | — |
| 2 | " | " | " | " | " | " | " | " | " | " | " | 20 PPM |
| 3 | a-SiN:H | 15 | 15/0 | 1500Å | a-Si:H | 15 | 0 | 1 μm | a-SiC:H | 15 | 15/0 | 10 PPM |
| 4 | " | " | " | " | " | " | " | " | " | " | " | " |
| 5 | " | " | " | " | " | " | " | " | " | " | " | " |
| 6 | " | " | " | " | " | " | " | " | " | " | " | " |
| 7 | a-SiN:H:F | 15 | 14/4 | 1500Å | a-Si:H:F | 15 | 5 | 1 μm | a-SiC:H | 15 | 13/4 | 20 PPM |
| 8 | " | " | " | " | " | " | " | " | " | " | " | " |
| 9 | " | " | " | " | " | " | " | " | " | " | " | " |
| 10 | " | " | " | " | " | " | " | " | " | " | " | " |
| 11 | " | " | " | " | " | " | " | " | " | " | " | " |
| 12 | a-SiN:H | 15 | 15/0 | 1500Å | a-Si:H | 15 | 0 | 1 μm | a-SiC:H | 15 | 15/0 | — |
| 13 | " | " | " | " | " | " | " | " | " | " | " | 50 PPM |
| 14 | " | " | " | " | " | " | " | " | " | " | " | 100 PPM |
| 15 | " | " | " | " | " | " | " | " | " | " | " | 500 PPM |
| 16 | a-SiN:H:F | 40 | 15/5 | 1500Å | a-Si:H:F | 15 | 5 | 1.5 μm | a-SiC:H:F | 2.5 | 15/5 | 10 PPM |
| 17 | " | " | " | " | " | " | " | " | " | 10 | 15/5 | " |
| 18 | " | " | " | " | " | " | " | " | " | 20 | 13/4 | " |
| 19 | " | " | " | " | " | " | " | " | " | 30 | 15/4 | " |
| 20 | " | " | " | " | " | " | " | " | " | 40 | 15/5 | " |

| | | Blocking layer | | | | | | | | | |
|---|---|---|---|---|---|---|---|---|---|---|---|
| Example | Charge transport layer Thickness | Composition | C (%) | H (%)/F (%) | doping concentration | Thickness | Charge potential $V_0$(V) | Half decay exposure amount E ½ (lux. sec.) | Residual potential $V_R$(V) | Picture quality 1000 copy | Picture quality 200000 copy |
| 1 | 15 μm | a-SiC:H | 15 | 15/0 | 500 PPM | 5000Å | ⊕600 | 2.7 | 37 | Δ | X |
| 2 | " | " | " | " | " | " | ⊕570 | 1.0 | 2 | ◎ | ◎ |
| 3 | 15 μm | a-SiC:H | 15 | 15/0 | 100 PPM | 5000Å | ⊕330 | 0.6 | 1 | Δ | X |
| 4 | " | " | " | " | 1000 PPM | " | ⊕610 | 0.8 | 5 | ◎ | ◎ |
| 5 | " | " | " | " | 2000 PPM | " | ⊕640 | 1.1 | 9 | ◎ | ◎ |
| 6 | " | " | " | " | 5000 PPM | " | ⊕600 | 2.4 | 20 | ○ | Δ |
| 7 | 15 μm | a-SiC:H:F | 15 | 13/4 | 1000 PPM | 200Å | ⊕360 | 0.7 | 2 | Δ | Δ |
| 8 | " | " | " | " | " | 500Å | ⊕580 | 0.9 | 5 | ◎ | ○ |
| 9 | " | " | " | " | " | 5000Å | ⊕640 | 1.0 | 5 | ◎ | ◎ |
| 10 | " | " | " | " | " | 8000Å | ⊕670 | 1.5 | 9 | ◎ | ○ |
| 11 | " | " | " | " | " | 2.5 μm | ⊕700 | 2.9 | 37 | Δ | Δ |
| 12 | 15 μm | a-SiC:H | 15 | 15/0 | 500 PPM | 5000Å | ⊕600 | 2.8 | 36 | Δ | X |
| 13 | " | " | " | " | " | " | ⊕580 | 0.9 | 4 | ◎ | ◎ |
| 14 | " | " | " | " | " | " | ⊕530 | 1.1 | 5 | ◎ | ○ |
| 15 | " | " | " | " | " | " | ⊕310 | 1.2 | 4 | Δ | X |
| 16 | 15 μm | a-SiC:H:F | 15 | 13/4 | 1000 PPM | 5000Å | ⊕350 | 0.5 | 2 | Δ | X |
| 17 | " | " | " | " | " | " | ⊕580 | 0.7 | 4 | ◎ | ○ |
| 18 | " | " | " | " | " | " | ⊕650 | 0.9 | 6 | ◎ | ◎ |
| 19 | " | " | " | " | " | " | ⊕710 | 1.2 | 12 | ◎ | ○ |
| 20 | " | " | " | " | " | " | ⊕790 | 3.1 | 50 | X | X |

What is claimed is:

1. An electrophotographic photoreceptor comprising a photosensitive layer comprising at least one compound selected from the group consisting of hydrogenated amorphous silicon and fluorinated amorphous silicon, a surface modifying layer formed on the upper surface of said photosensitive layer and comprising at least one compound selected from the group consisting of hydrogenated amorphous silicon carbide, fluorinated amorphous silicon carbide, hydrogenated and fluorinated amorphous silicon carbide, hydrogenerated amorphous silicon nitride, fluorinated amorphous silicon nitride, and hydrogenated and fluorinated amorphous silicon nitride, a charge transport layer formed on the lower surface of said photosensitive layer comprising at least one compound selected from the group consisting of hydrogenated amorphous silicon carbide, fluorinated amorphous silicon carbide, and hydrogenated and fluorinated amorphous silicon carbide, the carbon content of said charge transport layer is within the range of 5 to 30 atomic % and said charge transport layer is doped with boron and is formed in a glow discharge decomposition process whereby boron atoms are doped at a flow rate ratio of $[B_2H_6]/[SiH_4]=1-100$ ppm., and the charge blocking layer is formed into a p-type in glow discharge decomposition process at a flow rate ratio of $[B_2H_6]/[SiH_4]=200-2000$ ppm, a charge blocking layer formed on the lower surface of said charge transport layer comprising at least one compound selected from the group consisting of hydrogenated amorphous silicon carbide, fluorinated amorphous silicon carbide, and hydrogenated and fluorinated amorphous silicon carbide, doped with a larger amount of at least one element from group III of the periodic table than the amount of boron atoms in said charge transport layer, and a substrate.

2. The electrophotographic photoreceptor as claimed in claim 1 wherein the surface modifying layer has a thickness of 400 Å–5000 Å, the photosensitive layer has a thickness of 2500 Å–10 μm, the charge transport layer has a thickness of 10 μm–30 μm, and the charge blocking layer has a thickness of 400 Å–2 μm.

3. The electrophotographic photoreceptor as claimed in claim 2 wherein the charge transport layer contains hydrogen atoms within a range of 10–30 atomic %, and fluorine atoms, when present, within a range of 0.5–10 atomic %.

4. The electrophotographic photoreceptor as claimed in claim 2 wherein photosensitive layer contains hydrogen atoms within a range of 10–30 atomic %, and fluoriee atoms, when present, within a range of 0.5–10 atomic %.

5. The electrophotographic photoreceptor as claimed in claim 2 wherein the surface modifying layer contains at least one of carbon atoms and nitrogen atoms within a range of 10–70 atomic %, hydrogen atoms within a range of 10–30 atomic and fluorine atoms, when present, within a range of 0.5–10 atomic %.

6. The electrophotographic photoreceptor as claimed in claim 4 wherein the charge blocking layer contains carbon atoms within a range of 5–30 atomic %, hydrogen atoms within a range of 10–30 atomic %, and fluorne atoms, when present, within a range of 0.5–10 atomic %.

7. The electrophotographic photoreceptor as claimed in claim 2 wherein the surface modifying layer has a thickness of 400 Å–2000 Å.

8. The electrophotographic photoreceptor as claimed in claim 1 wherein said doping element present in said said charge blocking layer is boron.

9. The electrophotographic photoreceptor as claimed in claim 2 wherein said charge transport layer contains hydrogen-atoms within a range of 10–30 atomic %, and fluorine atoms, when present, within a range of 0.5–10 atomic %;

said photosensitive layer contains hydrogen atoms within a range of 10–30 atomic %, and fluorine atoms, when present, within a range of 0.5–10 atomic %;

said surface modifying layer contains at least one of carbon atoms and nitrogen atoms within a range of 10–70 atomic %, hydrogen atoms within a range of 10–30 atomic %, and fluorine atoms, when present, within a range of 0.5–10 atomic %; and said charge blocking layer contains carbon atoms within a range of 5–30 atomic %, hydrogen atoms within a range of 10–30 atomic %, and fluorine atoms, when present, within a range o 0.5–10 atomic %.

10. The electrophotographic photoreceptor as claimed in claim 8 wherein said surface modifying layer has a thickness of 400 Å–2000 Å.

11. The electrophotographic photoreceptor as claimed in claim 10 wherein said doping element present in said charge blocking layer is boron.

12. The electrophotographic photoreceptor as claimed in claim 11 wherein said charge blocking layer has a thickness of 50 Å–2 μm.

13. The electrophotographic photoreceptor as claimed in claim 2 wherein said charge blocking layer has a thickness of 50 Å–2 μm.

14. The electrophotographic photoreceptor as claimed in claim 12 wherein said charge blocking layer contains carbon atoms within the range of 10–30 atomic %.

15. The electrophotographic photoreceptor as claimed in claim 9 wherein said charge blocking layer contains carbon atoms within the rangc of 10–30 atomic %.

16. The electrophotographic photoreceptor as claimed in claim 6 wherein said charge blocking layer contains carbon atoms within the range of 10–30 atomic %.

* * * * *